US010217591B1

(12) United States Patent
Blankemeyer

(10) Patent No.: US 10,217,591 B1
(45) Date of Patent: Feb. 26, 2019

(54) CIRCUIT BREAKER TOGGLE LINK APPARATUS, TOGGLE LINK ASSEMBLIES, CIRCUIT BREAKER TRIP MECHANISM ASSEMBLIES, AND METHODS OF LIMITING CRADLE MOTION OF A CIRCUIT BREAKER

(71) Applicant: Siemens Aktiengesellschaft, München (DE)

(72) Inventor: Mark Blankemeyer, Suwanee, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/807,722

(22) Filed: Nov. 9, 2017

(51) Int. Cl.

| | |
|---|---|
| ***H01H 71/52*** | (2006.01) |
| ***H01H 71/12*** | (2006.01) |
| ***H01H 71/10*** | (2006.01) |

(52) U.S. Cl.
CPC ..... *H01H 71/12* (2013.01); *H01H 71/10* (2013.01); *H01H 71/525* (2013.01); *H01H 71/526* (2013.01)

(58) Field of Classification Search
CPC ..... H01H 71/10; H01H 71/505; H01H 71/525
USPC ..... 200/401; 335/167, 172, 189, 191
See application file for complete search history.

(56) References Cited

U.S. PATENT DOCUMENTS 5,449,871 A * 9/1995 Batteux ..... H01H 71/501 200/401
6,798,324 B2 * 9/2004 Richter ..... H01H 71/525 335/172

* cited by examiner

*Primary Examiner* — Vanessa Girardi

(57) ABSTRACT

A toggle link apparatus for a circuit breaker. The toggle link apparatus has an open-slotted end including a pivot feature and a stop feature opposite the pivot feature that limits motion of a connected cradle upon a tripping event. Toggle link assemblies of a circuit breaker, trip mechanism assemblies, and method of operating a trip mechanism of a circuit breaker are also provided, as are other aspects.

18 Claims, 7 Drawing Sheets

*"Prior Art"*

CIRCUIT BREAKER TOGGLE LINK APPARATUS, TOGGLE LINK ASSEMBLIES, CIRCUIT BREAKER TRIP MECHANISM ASSEMBLIES, AND METHODS OF LIMITING CRADLE MOTION OF A CIRCUIT BREAKER

FIELD

The disclosure relates to circuit breakers for interrupting power from an electrical power supply, and more particularly to toggle link apparatus for circuit breakers, and assemblies and methods utilizing such toggle link apparatus.

BACKGROUND

Circuit breakers are commonplace for use in residential and commercial applications. Certain circuit breakers, as shown in FIG. 1, can include a trip mechanism assembly 100 that includes an upper toggle link 102 that is coupled to a cradle 104 wherein the cradle 104 is pivotal about a pivot end 104P relative to a frame or case. The upper toggle link 102 includes an open-slotted end 106 having an inverted u-shape as is shown in FIG. 1. The open-slotted end 106 of the upper toggle link 102 includes a pivot feature 106P that allows a lower toggle link 108 including a toggle pin 110 to rotate in the pivot joint 106P during most of the excursion of the trip mechanism 100. The upper toggle link 102 is pivotable about a mid-pivot 104M of the cradle 104 at an upper end, and the second toggle link 108 is pivotable about a lower pivot 112 on a crossbar assembly 114. Crossbar assembly 114 includes a crossbar housing 114H and one or more moveable contact fingers 115 including moveable electrical contacts 115C at an end thereof. A latch 116 interfaces with a latch portion 104L of the cradle 104 to release the cradle and open the electrical contacts, i.e., separate the moveable contact 115C from a stationary contact (not shown). Having an open-slotted end 106, as shown in FIG. 1, vastly simplifies the circuit breaker assembly process by allowing the open-slotted end 106 to slide over the toggle pin 110. However, under certain circumstances, this open-slotted toggle configuration may contribute to performance concerns.

Accordingly, a need therefore exists to provide improved circuit breakers and trip mechanism assemblies and toggle links that provide improved performance.

SUMMARY

According to one aspect, an improved toggle link of a circuit breaker is provided. The toggle link includes a link body having a pivot end and an engagement end opposite the pivot end, the engagement end including an open-ended slot including a pivot feature and a stop feature configured to interface with a toggle pin.

According to another aspect, a toggle link assembly of a circuit breaker is provided. The toggle link assembly includes a first toggle link including a link body having a pivot end coupleable with a cradle and an engagement end opposite the pivot end, the engagement end including an open-ended slot including a pivot feature and a stop feature, and a second toggle link including a first end engageable with a crossbar assembly and a second end including a toggle pin, the toggle pin received in the open-ended slot.

According to a third aspect, a method of operating a trip mechanism assembly of a circuit breaker is provided. The method includes providing the trip mechanism having a cradle, a latch configured to delatch the cradle, a crossbar assembly including moveable contact fingers, a first toggle link including a link body having a pivot end coupled to the cradle and an engagement end opposite the pivot end, the engagement end including an open-ended slot including a pivot feature and a stop feature, and a second toggle link including a first end coupled to the crossbar assembly and a second end including a toggle pin, the toggle pin received in the open-ended slot, and restraining to the motion of the cradle during a tripping event with the stop feature.

Still other aspects, features, and advantages of the disclosure may be readily apparent from the following detailed description wherein a number of example embodiments are described and illustrated, including the best mode contemplated for carrying out the invention. The several details of the disclosure may be modified in various respects, all without departing from the scope of the invention. Accordingly, the drawings and descriptions are to be regarded as illustrative in nature, and not as restrictive. The disclosure covers all modifications, equivalents, and alternatives falling within the scope of the claims.

BRIEF DESCRIPTION OF DRAWINGS

The drawings, described below, are for illustrative purposes only and are not necessarily drawn to scale. The drawings are not intended to limit the scope of the invention in any way.

DETAILED DESCRIPTION

Figure 1:
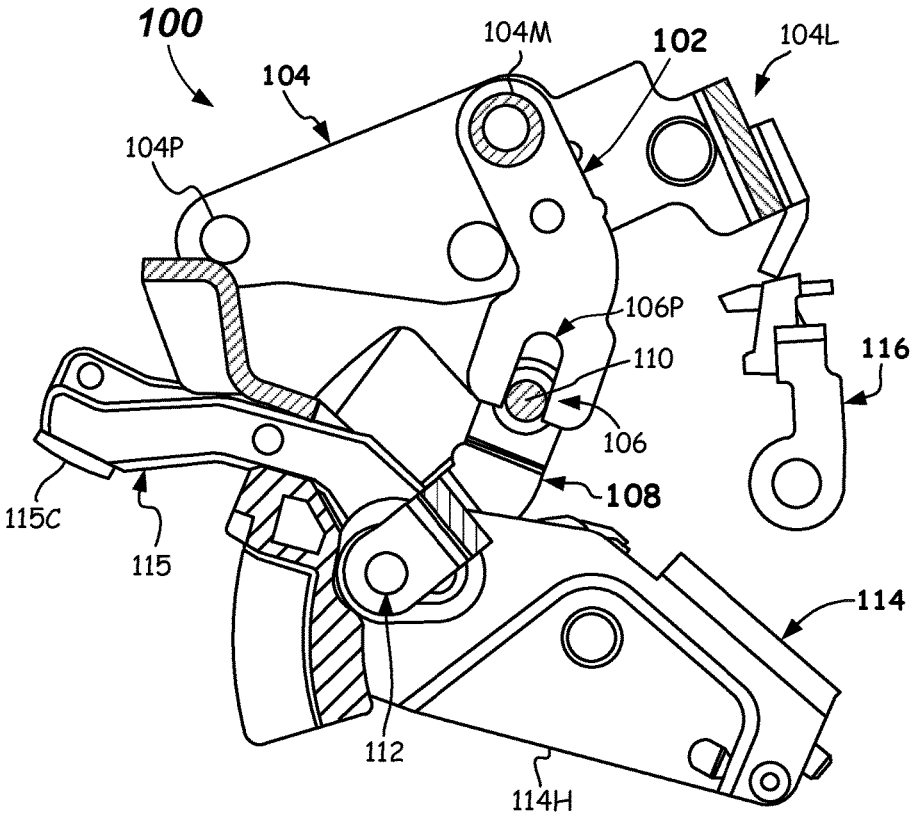
FIG. 1 illustrates a side plan view of a trip mechanism assembly including a first (e.g., upper) toggle link and a second (e.g., lower) toggle link of a circuit breaker according to the prior art.

Reference will now be made in detail to the example embodiments of this disclosure, which are illustrated in the accompanying drawings. Wherever possible, the same reference numbers will be used throughout the drawings to refer to the same or like parts.

In a typical trip mechanism 100 of a circuit breaker, when the circuit breaker in an "ON" position, the trip mechanism 100 is latched and a crossbar assembly 114 is rotated to close the movable contact fingers 115 including the moveable contacts 115C against line side contacts (not shown), which may be one or more fixed electrical contacts and thus connect the electrical load to the source of electrical power. During a tripping event, such as from a short circuit, a trip bar of the trip mechanism assembly will release the latch 116, which in turn will delatch the cradle 104. Upon being delatched, a mechanism spring (not shown) that is coupled to the cradle 104 will cause the crossbar assembly 114 to rotate away from the fixed contacts, which separates the electrical contacts and opens the protected circuit. The crossbar assembly 114 will continue to rotate under the force of the mechanism spring until the movable contact fingers 115 are stopped, such as by a stop mechanism (e.g., a frame tie and possibly an absorber).

In the initial stages of tripping, the toggle link assembly including the upper toggle link 102 and lower toggle link 108, and the cradle 104 rotate together with the crossbar assembly 114. However, in some instances, the kinetic energy and momentum of the upper toggle link 102 and cradle 104 imparted by the mechanism spring (not shown), can cause the upper toggle link 102 and the coupled cradle 104 to continue their rotation. The rotation can continue until either the mechanism spring absorbs all of this momentum, or in some cases, such as where the mechanism spring may have been weakened, the cradle 104 can be stopped by a collision with some other part of the circuit breaker, such as, the underside of the operating handle (not shown).

The operating handle allows the operator to manually open or close the circuit breaker. In other instances, this extreme cradle rotation can be beyond (e.g., above) the upper location of the latch 116. In these instances, the cradle 104 can become jammed on an end of the latch 116 as shown in FIG. 1. This undesirably results in a jam and locking up of the cradle 104 and the trip mechanism assembly. In such over-rotation scenarios where the cradle 104 rotates into the operating handle, the operating handle could be damaged and possibly affect the trip position of the operating handle. In some embodiments, such collisions can be so severe that they can result in bending of some mechanism components that could result in breaker malfunction. In the case of jamming wherein the cradle 104 becomes jammed on the latch 116 in an over-rotated condition, the jamming cannot be undone by an operator, as the jamming can only be cleared by disassembly and manual rotation of the latch to clear the jamming condition. Of course, this jamming condition is untenable and in need of a solution.

In view of the problems of the prior art toggle link assemblies and trip mechanism assemblies of circuit breakers, embodiments of the disclosure provide an improved toggle link assembly and trip mechanism assembly including the toggle link assembly. The improved trip mechanism assembly provides a cradle rotation limit function. In particular, the trip mechanism assembly includes an improved toggle link assembly that includes a stop feature. In some embodiments, a stop feature can be added to the upper toggle link and the improved toggle link assembly functions to limit rotational motion of the cradle. The stop feature may prevent the cradle from rotating above a predefined position within the internal confines of the circuit breaker. For example, the stop feature may prevent the cradle from becoming positioned above a top of the latch, so that jamming or locking up of the trip mechanism assembly is avoided or minimized. Moreover, the toggle link assembly including a stop feature may prevent the cradle from colliding with other circuit breaker components, such as, the underside or part of the operating handle.

One advantage of the improved trip mechanism assembly and toggle link assembly is that a limit stop feature can be accommodated without increasing a size of the circuit breaker. In some embodiments, the stop feature is included in the upper toggle link. Further details and aspects of trip mechanism assemblies, toggle link assemblies, toggle links, and methods of operating a trip mechanism assembly of a circuit breaker are provided, and will be described below in connection with FIGS. 2A-6.

Figure 2A:
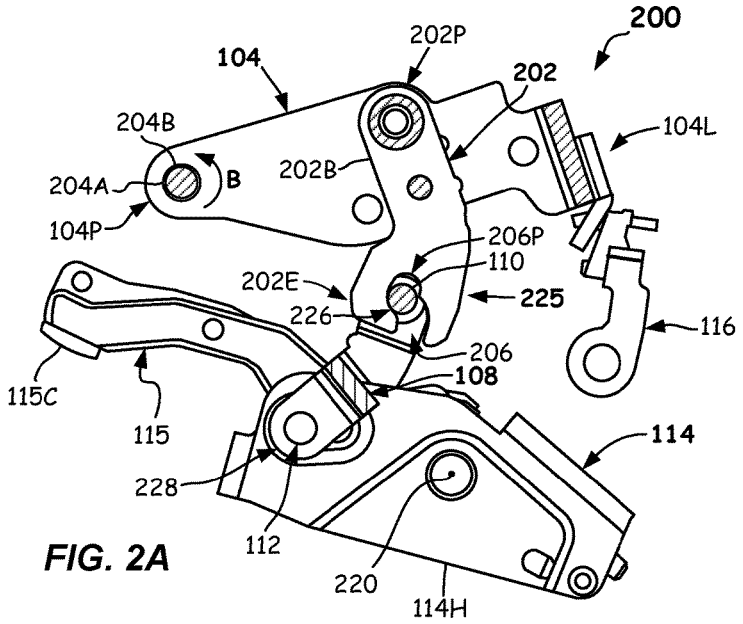
FIG. 2A illustrates a partially cross-sectioned side plan view of a trip mechanism assembly including a toggle link assembly in an operational configuration with a toggle pin engaged with a stop feature thus limiting cradle rotation according to embodiments (with the lower toggle link shown sectioned).
Figure 2B:
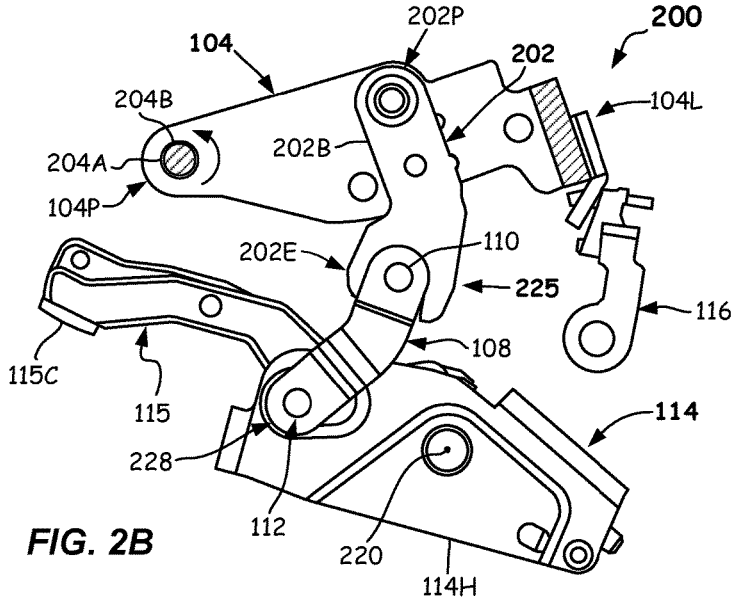
FIG. 2B illustrates a side plan view of a trip mechanism assembly including a toggle link assembly according to embodiments (with the lower toggle link fully shown).

FIGS. 2A and 2B illustrate part of the components of a trip mechanism assembly 200 of a circuit breaker in accordance with one or more embodiments. The other components of the circuit breaker are not shown, but are conventional. The trip mechanism assembly 200 includes, in the embodiment shown, a cradle 104 that can pivot about the pivot end 104P. For example, the pivot end 104P may include an aperture 204A formed in the cradle 104 that receives a fixed pivot pin 204B therein. Fixed pivot pin 204B may be inserted into, extend from, or be a part of a molded case or a rigid frame of the circuit breaker (not shown). The other end of the cradle 104 is the latch end 104L that interfaces with the latch 116 to delatch the cradle 104. Delatch of the cradle 104 can occur upon throwing the operating handle to OFF or by undergoing a short circuit event causing tripping of the trip mechanism assembly 200. For example, a trip bar (not shown) may engage with the latch 116 and cause the latch 116 to rotate clockwise to delatch and release the cradle 104. Any suitable latch construction configured to cause delatching of the cradle 104 may be used.

The trip mechanism assembly 200 may further include a crossbar assembly 114 including one or more moveable contact fingers 115. The number of moveable contact fingers 115 may be between 1 and 8 per pole and a separate crossbar assembly 114 may be provided for each pole. The moveable contact fingers 115 may themselves be moveable (e.g., pivotable) relative to the crossbar housing 114H. An example of the construction of the crossbar assembly 114 is further described in U.S. Pat. No. 8,901,446 to Fong et al. entitled "Limit Stop Apparatus, Circuit Breakers Including Limit Stops, And Methods Of Using Same." The crossbar assembly 114 is pivotal about a fixed axis 220, shown as a dot in FIGS. 2A-2B. The crossbar housings 114H may be tied together by a front bar or other securement so that the crossbar housings 114H rotate together in unison.

Again referring to FIGS. 2A-2B, FIGS. 3A-3B, and FIGS. 4A-4B the trip mechanism assembly 200, which is operable and connected to one pole, such as a center pole in a 3-pole circuit breaker, is shown. The trip mechanism assembly 200 includes a toggle link assembly 225 that includes a limit stop feature. The toggle link assembly 225 includes a first toggle link 202 (e.g., an upper toggle link, as shown), a second toggle link 108 (e.g., a lower toggle link, as shown), and a toggle pin 110. Upper and lower are used herein to denote the orientation shown, but it should be recognized that the orientation of the first toggle link 202 (e.g., an upper toggle link, as shown) and a second toggle link 108 (e.g., a lower toggle link, as shown), may be reversed in some embodiments.

In more detail, the first toggle link 202 includes a link body 202B having a pivot end 202P. In the configuration shown, the pivot end 202P can be coupled to the cradle 104 and include an engagement end 202E opposite from the pivot end 202P. The engagement end 202E includes an open-ended slot 206 including a pivot feature 206P and a stop feature 226. The second toggle link 108 includes a first end 228 that in the configuration shown can be coupled to the crossbar assembly 114 and has a second end 230 including a toggle pin 110. The toggle pin 110 can be slidably received in the open-ended slot 206. In the depicted embodiment, the pivot feature 206P may comprise a semi-circular surface slightly larger than a diameter of the toggle pin, which may function as a bearing surface.

Figure 4A:
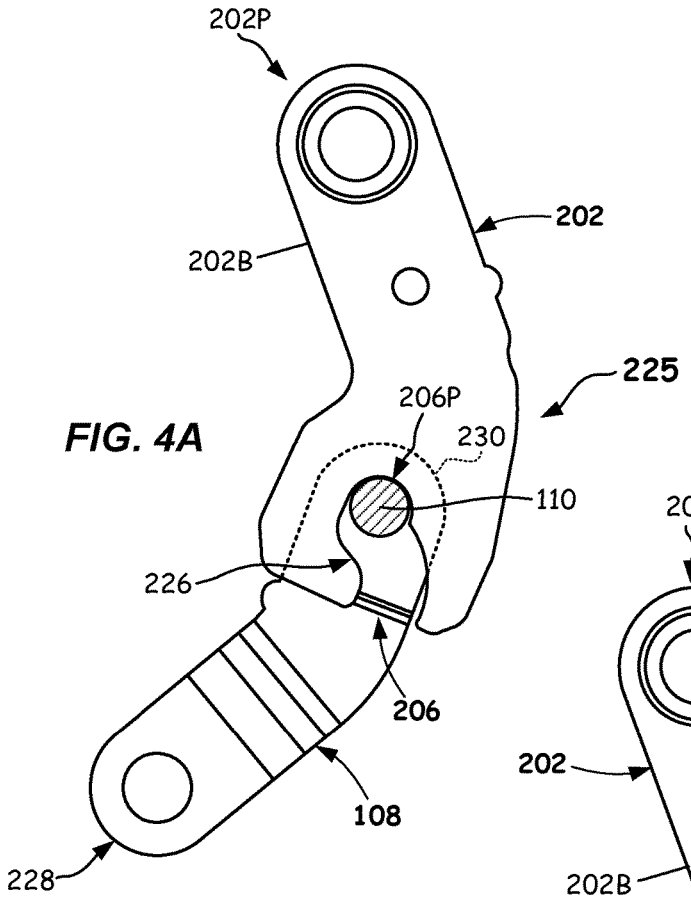
FIGS. 4A and 4B illustrate side plan views of a toggle link assembly in a first pivoting condition with toggle pin engaged with a pivot feature (FIG. 4A) and a second extended condition with toggle pin engaged with a stop feature (FIG. 4B) according to embodiments.
Figure 4B:
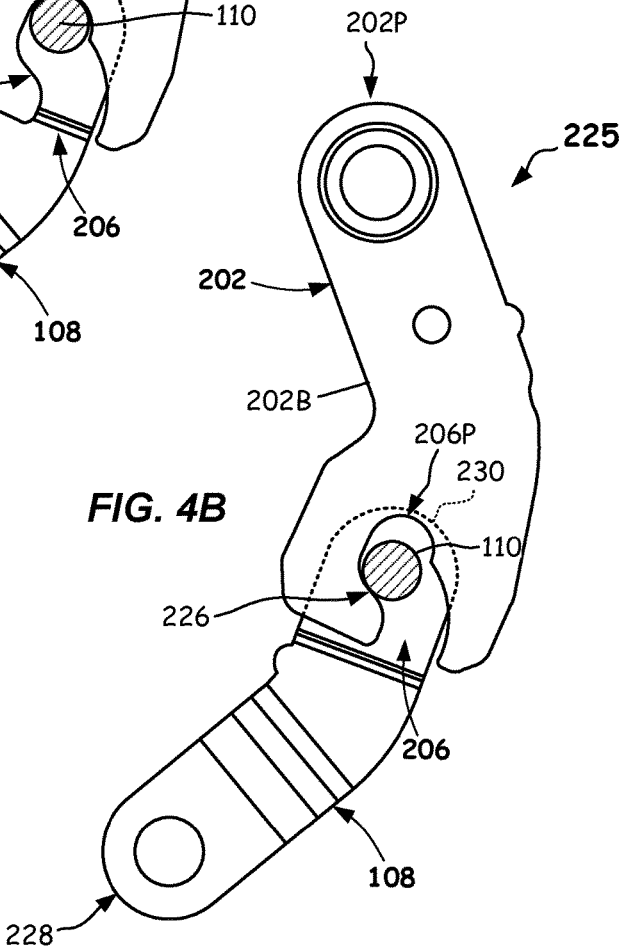

As best shown in FIGS. 4A and 4B, the toggle pin 110 of the toggle link assembly 225 is received in the open-ended slot 206 and is moveable between, and in contact with, the pivot feature 206P and the stop feature 226. The stop feature 226 is configured to limit rotation of the cradle 104 to a predetermined amount upon encountering a tripping event. FIG. 4A illustrates the toggle pin 110 in contact with the pivot feature 206P in a configuration that exists prior to the momentum of the cradle 104 and first toggle link 202 separating the toggle pin 110 from the pivot feature 206P during a tripping event.

FIG. 4B illustrates the toggle pin 110 in contact with the stop feature 226 that is formed on a side of the open-ended slot 206. Stop feature 226 in this embodiment is constructed as an angled surface. Stop feature 226 contacts the toggle pin 110 upon over rotation of the cradle 104 and separation of the first toggle link 202 from the second toggle link 108. This contact between the toggle pin 110 and the stop feature 226 limits the motion of the cradle 104 to a predetermined amount of rotation in direction B (FIG. 2A), such as about 2.7 degrees or less. In some embodiments, the rotation is limited to an extent that no portion of the latch portion 104L of the cradle 104 can rise above the top of the latch 116. Thus, the stop feature 226 prevents or minimizes the cradle 104 from becoming jammed on (e.g., atop of) the latch 116.

Figure 3A:
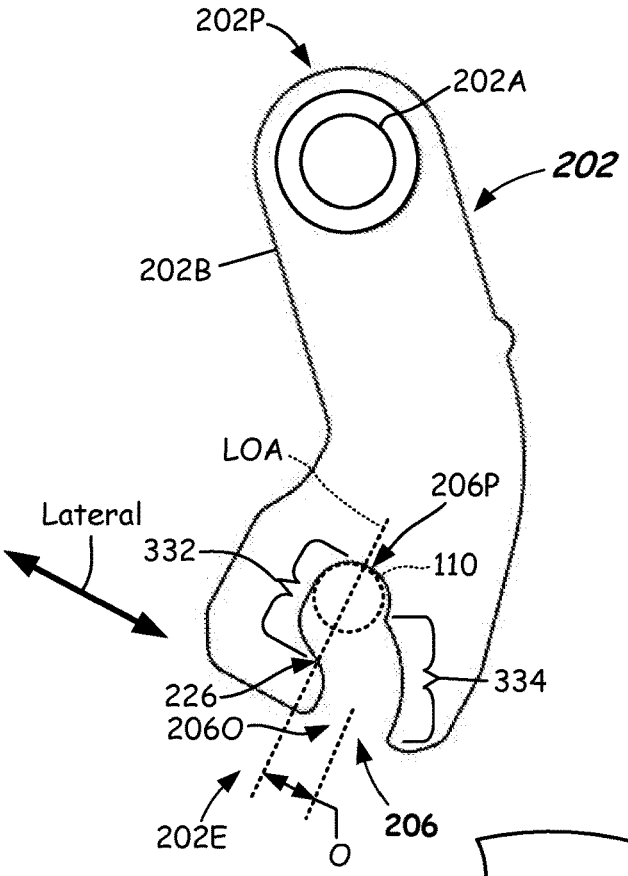
FIG. 3A illustrates a side plan view of a first toggle link (e.g., upper toggle link) of a toggle link assembly of a circuit breaker including an open-ended slot including a pivot feature and a stop feature according to embodiments.
Figure 3B:
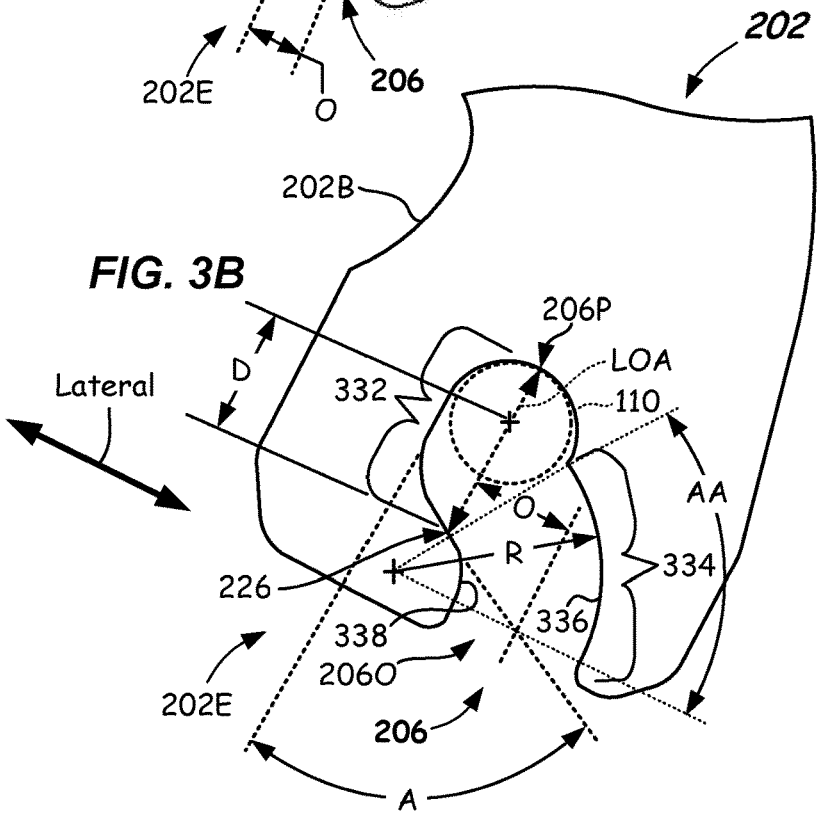
FIG. 3B illustrates an enlarged, partial side plan view of the first toggle link (e.g., upper toggle link) of FIG. 3A illustrating details of the open-ended slot including the pivot feature and stop feature according to embodiments.

In one aspect, the disclosure provides a toggle link 202 of a circuit breaker. An example of the toggle link 202 is best shown in FIGS. 3A and 3B, and comprises a link body 202B having a pivot end 202P and an engagement end 202E opposite the pivot end 202P. The pivot end 202P is pivotal on the cradle 104, and may include an aperture 202A that receives a pin or the like therein. The engagement end 202E comprises an open-ended slot 206 formed therein. In particular, the open-ended slot 206 includes a pivot feature 206P and a stop feature 226, each of which is configured to interface with a toggle pin 110. The toggle pin 110 may be provided with any suitable construction that extends sideways through the open-ended slot 206.

The toggle link 202 may include a configuration wherein the open-ended slot 206 includes a first slot region 332 extending from the pivot feature 206P to the stop feature 226. This first slot region 332 provides a first channel for the toggle pin 110 to move within. The first slot region 332 may be aligned substantially along a line of action LOA. The LOA may be a line or slight arc that the toggle pin 110 will naturally take upon separation of the first toggle link 202 from the second toggle link 108 upon over-rotation of the cradle 104. As the toggle pin 110 contacts the stop feature 226, further separation between the first toggle link 202 and the second toggle link 108 is halted, and thus further rotation of the cradle 104 is stopped. The stop feature 226 may be positioned at a location such that a distance D between the pivot portion 206P and the stop feature 226 along the line of action LOA is between about 1.9 mm and about 6.8 mm, for example. Other values of the distance D may be used, depending upon the location and sizes of the latch 116 and latch portion 104L. In the depicted embodiment, the stop feature 226 comprises an angled surface formed on a side of the open-ended slot 206. For example, as shown in FIG. 3B, an angle A formed between a tangent to the surface (surface tangent) at the contact location with the stop feature 226 and the side surface of the first slot portion 332 may be greater than about 40 degrees, between about 45 degrees and 90 degrees, between about 45 degrees and 75 degrees, between about 50 degrees and 70 degrees, and about 60 degrees in some embodiments.

The open-ended slot 206 of the first toggle link 202 can further include a second slot region 334 intersecting with and extending away from the first slot region 332. The second slot region 334 can extend along a non-straight path from the stop feature 226 to an open end 206O of the open-ended slot 206. Thus, in the configuration shown, the open-ended slot 206 comprises a first slot region 332 extending from the pivot feature 206P to the stop feature 226, and a second slot region 334 extending from the stop feature 226 to an open end 206O of the open-ended slot 206. In the depicted embodiment, a center of the open end 206O can be positioned at a lateral offset distance O from the line of action LOA passing between the pivot feature 206P and the stop feature 226. In some embodiments, the lateral offset distance O can be greater than 2.2 mm, and between about 2.2 mm and about 7.1 mm in some embodiments. Other lateral offset distances O can be used.

In the depicted embodiment, the second slot region 334 can include a curved surface 336 on one side of the open-ended slot 206 having a radius R of between about 5.6 mm and about 10.0 mm. Other values of radius R can be used. The curved surface 336 may extend through an arc AA of between about 45 degrees and about 75 degrees, for example. In the depicted embodiment, the second slot region 334 can include an opposed surface 338 that is opposed to the curved surface 336. Opposed surface 338 may also include an arc thereon.

The values for D, O, and R may be dependent on the diameter of the toggle pin 110 and where the toggle pin 110 pivots with the first toggle link 202. A 3-pole circuit breaker designed for 800 amp to 1200 amp frames can use a 5.0 mm diameter of the toggle pin 110, but smaller (e.g., circuit breakers designed for 100 A frame) could use a diameter of the toggle pin 110 of 2.5 mm. The range of values for A and AA are independent of the diameter of the toggle pin 110. One example embodiment of a 3-pole circuit breaker includes D=4.7 mm, O=4.35 mm, R=8.7 mm, AA=60 degrees, and A=60 degrees. Other values may be used.

Figure 4C:
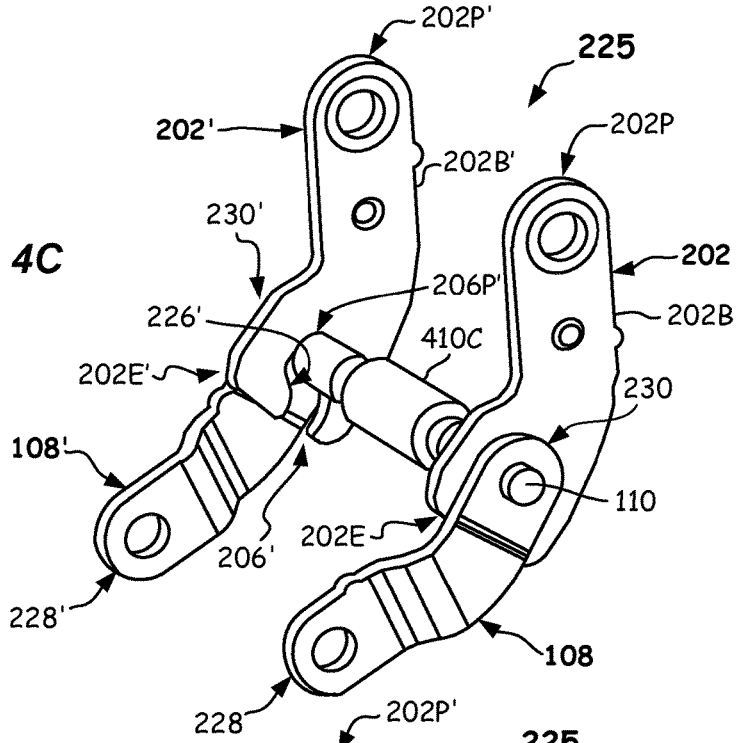
FIG. 4C illustrates an isometric view of a toggle link assembly of multiple toggle links of a circuit breaker shown in a pivoting configuration with the toggle pin engaging the pivot feature according to embodiments.
Figure 4D:
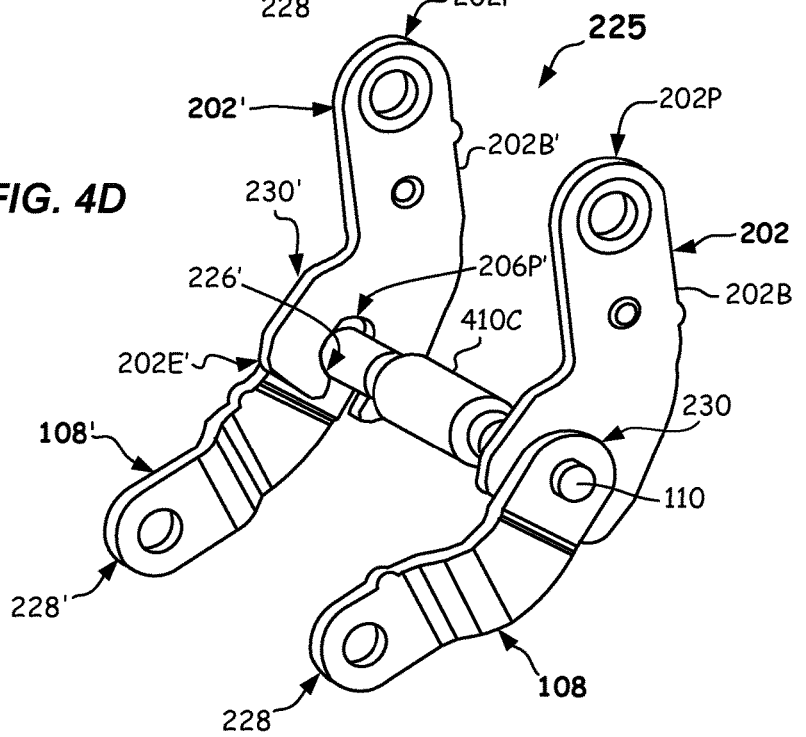
FIG. 4D illustrates an isometric view of a toggle link assembly of multiple toggle links of a circuit breaker shown in an extended configuration with the toggle pin engaging a stop feature according to embodiments.

Now referring to FIG. 4C and FIG. 4D, in addition to the first toggle link 202 and second toggle link 108, the toggle link assembly 225 may comprise a third toggle link 202' including a link body 202B' having a pivot end 202P' coupleable with the cradle 104 (e.g., with another side of the cradle 104) and an engagement end 202E' opposite the pivot end 202P'. The engagement end 202E' also includes an open-ended slot 206' including a pivot feature 206P' and a stop feature 226'. The toggle link assembly 225 may also comprise a fourth toggle link 108' including a first end 228' engageable with the crossbar assembly 114 (e.g., a second side of the crossbar assembly 114 and a second end 230' including the toggle pin 110. The toggle pin 110 is received in the open-ended slot 206P'. Thus, the toggle pin 110 can extend and span between the first toggle link 202 and the third toggle link 202'. The toggle pin 110 may include a first end that is received in the first open-ended slot 206 and a second end that is received in the open-ended slot 206'. The toggle pin 110 may include steps (e.g., shoulders or changes in diameter) adjacent to each of the first and third toggle links 202, 202' wherein the steps are large enough to prevent axial motion of the respective toggle links 202, 202' towards one another along the axis of the toggle pin 110. A larger central portion 410C of the toggle pin 110 may be enlarged to increase the overall strength of the toggle pin 110. Thus, the toggle link assembly 225 can straddle the crossbar housing 114H between ends 228, 228', and straddle the cradle 104 between pivot ends 202P, 202P'.

Figure 5:
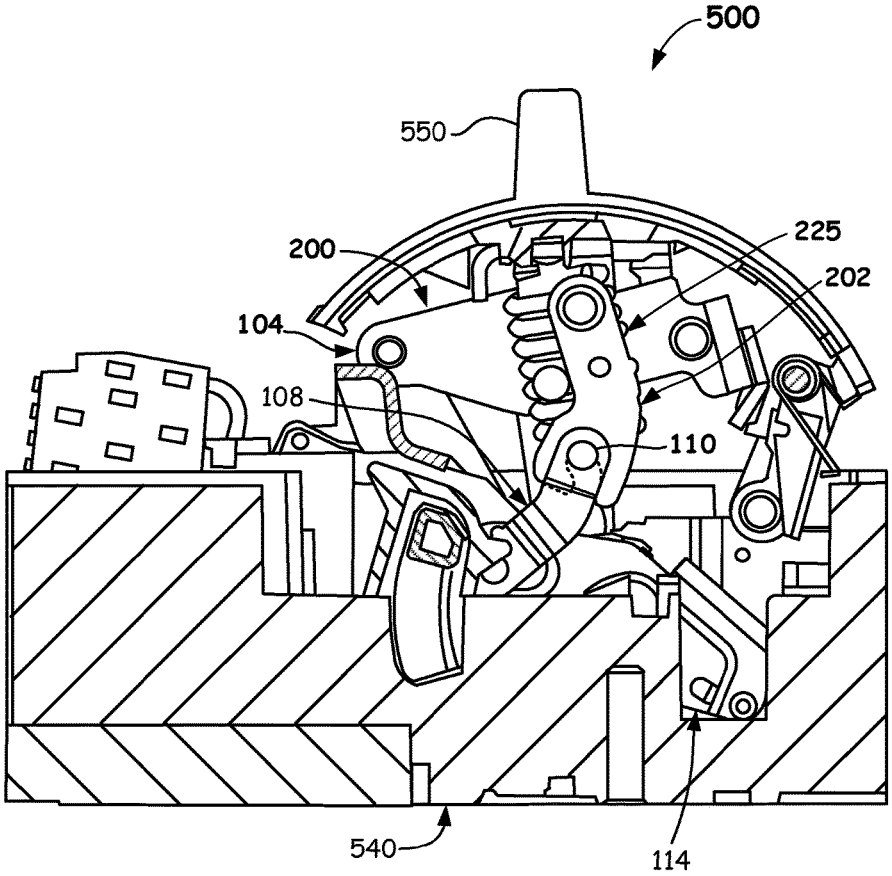
FIG. 5 illustrates a partial side plan view of a circuit breaker including a trip mechanism assembly and a toggle link assembly according to embodiments.

FIG. 5 illustrates a side plan view of an example circuit breaker 500 (with part of the molded case removed) including a molded case 540, a trip mechanism assembly 200 including the cradle 104, the crossbar assembly 114, and the toggle link assembly 225 of at least the first toggle link 202, second toggle link 108, and toggle pin 110.

Figure 6:
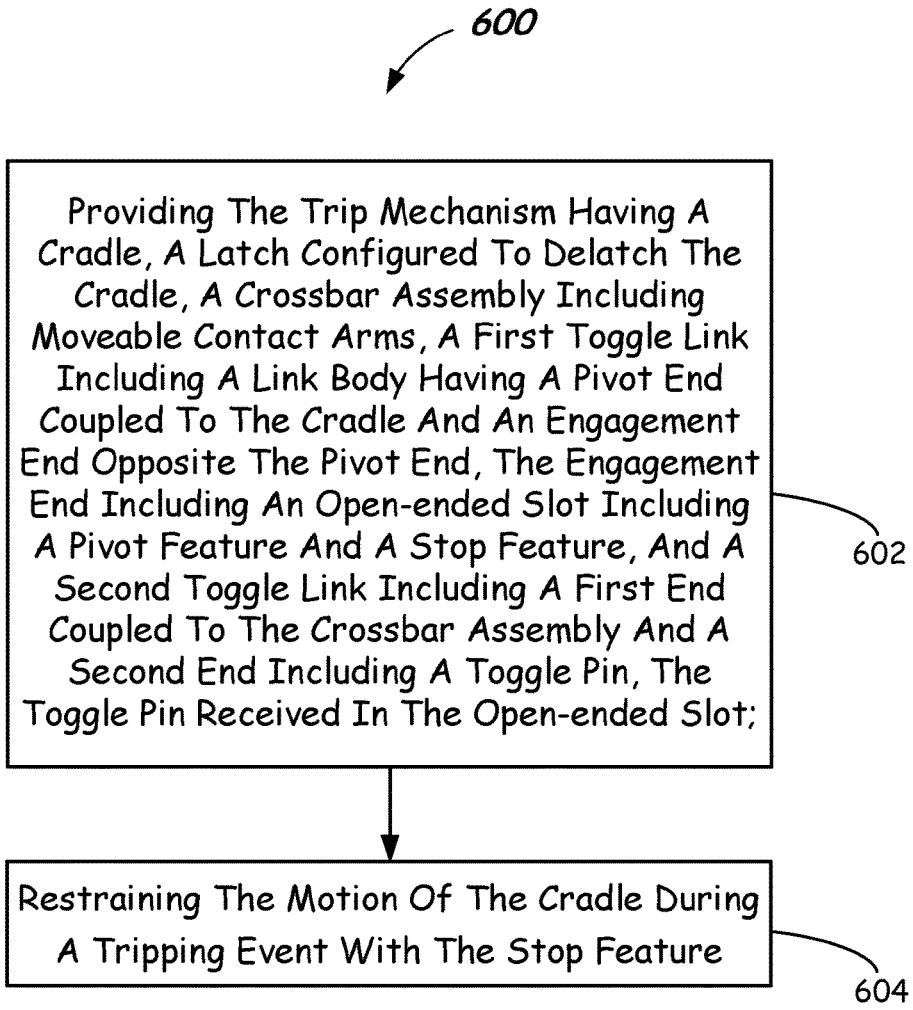
FIG. 6 illustrates a flowchart of a method of operating a trip mechanism assembly of a circuit breaker according to embodiments.

FIG. 6 illustrates a method 600 of operating a trip mechanism assembly (e.g., trip mechanism assembly 200) of a circuit breaker (e.g., circuit breaker 500) in accordance with one or more embodiments. At process block 602, method 600 can include providing the trip mechanism assembly having a cradle (e.g., cradle 104), a latch (e.g., latch 116) configured to delatch the cradle, a crossbar assembly (e.g., crossbar assembly 114) including moveable contact fingers (e.g., moveable contact fingers 115), a first toggle link (e.g., first toggle link 202) including a link body (e.g., link body 202B) having a pivot end (e.g., pivot end 202P) coupled to the cradle and an engagement end (e.g., engagement end 202E) opposite the pivot end, the engagement end including an open-ended slot (e.g., open ended slot 206) including a pivot feature (e.g., pivot feature 206P) and a stop feature (e.g., stop feature 226), and a second toggle link (e.g., second toggle link 206) including a first end 228 coupled to the crossbar assembly (e.g., to the cross bar housing 114H) and a second end (e.g., first toggle link 230) including a toggle pin (e.g., first pin 110), the toggle pin received in the open-ended slot.

The method 600 further comprises in block 604 restraining the rotational motion of the cradle (e.g., cradle 104) during a tripping event with the stop feature (e.g., stop feature 226). A tripping event is any event that causes release of the cradle 104 (e.g., a short circuit or other condition causing the latch 116 to delatch the cradle 104). As discussed above the degree of rotation of the cradle 104 is limited to a predefined amount by contact of the toggle pin (e.g., toggle pin 110) with the stop feature (e.g., stop feature 226). Thus, contact of the cradle (e.g., cradle 104) with the operating handle (e.g., operating handle 550) is minimized or avoided. Moreover, jamming of the cradle 104 with the latch 116 can also be minimized or avoided.

A person of ordinary skill in the art should readily appreciate that the embodiments described herein are susceptible of broad utility and application. Many embodiments and adaptations other than those described herein, as well as many variations, modifications, or equivalent arrangements, will be apparent from, or reasonably suggested by, the disclosure, without departing from the substance or scope of the claims. This disclosure is not intended to limit the invention to the particular apparatus, devices, assemblies, systems, or methods disclosed herein, but, to the contrary, the intention is to cover all modifications, equivalents, and alternatives falling within the scope of the claims.

What is claimed is:

1. A toggle link apparatus of a circuit breaker, comprising:
- a link body having a pivot end and an engagement end opposite the pivot end, the engagement end including:
- an open-ended slot including a pivot feature and a stop feature configured to interface with a toggle pin, wherein the open-ended slot comprises:
- a first slot region extending from the pivot feature to the stop feature of the open-ended slot, and
- a second slot region extending from the stop feature to an open end of the open-ended slot,
- wherein a center of the open end is positioned at a lateral offset distance O from a line of action LOA passing between the pivot feature to the stop feature.

2. The toggle link apparatus of claim 1, wherein the lateral offset distance O is between 2.2 mm and 7.1 mm.

3. The toggle link apparatus of claim 1, wherein an angle A between a side surface of the first slot region and a surface tangent of the stop feature is between 45 degrees and 90 degrees.

4. The toggle link apparatus of claim 1, wherein a distance D between the pivot feature to the stop feature of the open-ended slot along the line of action LOA is between about 1.9 mm and about 6.8 mm.

5. The toggle link apparatus of claim 1, wherein the second slot region includes opposed curved surfaces.

6. The toggle link apparatus of claim 1, wherein the pivot feature comprises a semi-circular surface.

7. A toggle link apparatus of a circuit breaker, comprising:
- a link body having a pivot end and an engagement end opposite the pivot end, the engagement end including:
- an open-ended slot including a pivot feature and a stop feature configured to interface with a toggle pin, wherein the open-ended slot comprises:
- a first slot region extending from the pivot feature to the stop feature, and
- a second slot region extending from the stop feature to an open end of the open-ended slot,
- wherein the second slot region includes a curved surface having a radius R of between 7.8 mm and 10 mm.

8. The toggle link apparatus of claim 7,
- wherein the second slot region includes the curved surface having a radius R and extending along an arc angle AA of between about 45 degrees and about 75 degrees.

9. The toggle link apparatus of claim 7,
- wherein the second slot region includes opposed curved surfaces.

10. The toggle link apparatus of claim 7, wherein the pivot feature comprises a semi-circular surface.

11. A toggle link assembly of a circuit breaker, comprising:
- a first toggle link including a link body having a pivot end coupleable with a cradle and an engagement end opposite the pivot end, the engagement end including an open-ended slot including a pivot feature and a stop feature; and
- a second toggle link including a first end engageable with a cross bar assembly and a second end including a toggle pin, the toggle pin received in the open-ended slot, wherein the open-ended slot comprises:
- a first slot region extending from the pivot feature to the stop feature of the open-ended slot, and
- a second slot region extending from the stop feature to an open end of the open-ended slot, wherein a center of the open end is positioned at a lateral offset distance O from a line of action LOA passing between the pivot feature to the stop feature.

12. The toggle link assembly of claim 11, wherein the toggle pin is received in the open-ended slot between the pivot feature and the stop feature.

13. The toggle link assembly of claim 11, wherein the toggle pin is received in the open-ended slot and is moveable between the pivot feature and the stop feature.

14. The toggle link assembly of claim 11, wherein the pivot end is coupled with a cradle that is rotatable in response to a tripping event.

15. The toggle link assembly of claim 11, wherein the first end of the second toggle link is coupled to the crossbar assembly.

16. The toggle link assembly of claim 11, comprising a third toggle link including a link body having a pivot end coupleable with the cradle and an engagement end opposite the pivot end, the engagement end including an open-ended slot including a pivot feature and a stop feature, and a fourth toggle link including a first end engageable with the crossbar assembly and a second end including the toggle pin, the toggle pin received in the open-ended slot.

17. A trip mechanism assembly of a circuit breaker, comprising:

a cradle;

a latch configured to delatch the cradle;

a crossbar assembly including moveable contact arms;

a first toggle link including a link body having a pivot end coupled to the cradle and an engagement end opposite the pivot end, the engagement end including an open-ended slot including a pivot feature and a stop feature; and a second toggle link including a first end coupled to the crossbar assembly and a second end including a toggle pin, the toggle pin received in the open-ended slot, wherein the open-ended slot comprises:

a first slot region extending from the pivot feature to the stop feature of the open-ended slot, and a second slot region extending from the stop feature to an open end of the open-ended slot, wherein a center of the open end is positioned at a lateral offset distance O from a line of action LOA passing between the pivot feature to the stop feature.

18. The trip mechanism assembly of claim 17, wherein the toggle pin is received in the open-ended slot and is moveable between the pivot feature and the stop feature to limit rotation of the cradle upon a tripping event.

* * * * *